US006978506B2

(12) United States Patent
Uskup

(10) Patent No.: US 6,978,506 B2
(45) Date of Patent: Dec. 27, 2005

(54) CLEANING IMPLEMENT

(76) Inventor: Timur Uskup, 636 W. Waveland #3E, Chicago, IL (US) 60613

( * ) Notice: Subject to any disclaimer, the term of this patent is extended or adjusted under 35 U.S.C. 154(b) by 338 days.

(21) Appl. No.: 10/336,862

(22) Filed: Jan. 7, 2003

(65) Prior Publication Data

US 2004/0128782 A1 Jul. 8, 2004

(51) Int. Cl.[7] ..... A47L 13/12

(52) U.S. Cl. ..... 15/114; 15/210.1; 15/160; 15/143.1; D32/42; D4/119; D4/134; D4/138

(58) Field of Search ..... 15/114, 110, 105, 15/115, 117, 210.1, 118, 160, 143.1; 132/73.5, 132/75.3; D32/42; D4/116, 119, 137, 134, D4/138

(56) References Cited

U.S. PATENT DOCUMENTS 1,510,898 A * 10/1924 Nikicser ..... 15/223
2,663,889 A * 12/1953 Fuglie ..... 15/114
D171,592 S * 3/1954 Gore ..... D4/119
4,407,213 A * 10/1983 Evans ..... 114/222
D343,297 S * 1/1994 Haines ..... D4/116
D356,683 S * 3/1995 Jefferson ..... D4/116
5,519,911 A * 5/1996 Callander ..... 15/114
5,564,148 A * 10/1996 Prevost et al. ..... 15/111
6,010,268 A * 1/2000 Sereg et al. ..... 401/207
D425,707 S * 5/2000 Olsson ..... D4/119
6,058,550 A * 5/2000 Kruger et al. ..... 15/160
D448,573 S * 10/2001 Chen ..... D4/119
6,353,960 B1 * 3/2002 Jannicelli, Jr. ..... 15/246

* cited by examiner

*Primary Examiner*—Gary K. Graham
(74) *Attorney, Agent, or Firm*—Dennis A. Gross; The Hill Firm

(57) ABSTRACT

A cleaning implement specifically adapted for stringed instruments such as guitars, includes a T-shaped body having a distal cross member, a bowed main body intermediate member and a proximal enlarged handle. The cross member has a soft cleaning surface on an underside thereof and the handle has projecting bristles on an undersurface thereof. The bowed intermediate body member is resiliently flexible.

5 Claims, 1 Drawing Sheet

CLEANING IMPLEMENT

BACKGROUND OF THE INVENTION

1. Field of the Invention

This invention relates to cleaning implements and more particularly to a cleaning implement that is specifically adapted for use on stringed instruments.

2. Description of the Related Art

Stringed instruments, such as guitars, mandolins, violins and the like present unique cleaning problems. First, such instruments are highly prized for their looks and considerable importance is placed on the fine finish look of a string instrument. However, such instruments are difficult to clean due to the many intricate curves and non-planer shapes involved as well as the obstruction of the surface by the strings.

Importantly, such instruments, particularly acoustic ones, are known to be responsive to the finish of the instrument. Particular concern is paid in the building and restoration of such instruments to the specific finish applied and any deterioration or damage to the finish can affect the sound of the instrument. For this reason, such instruments are treated quite carefully in cleaning.

In use, in addition to the normal build up of dust and dirt, string instruments acquire specific debris and detritus incidental to normal use. For example, the fingerboard, or fret board, of the instrument may collect an oily residue of abraded skin as can the body of finger-played instruments such as guitars. For bow-played instruments the body will be exposed to rosin from the bow.

The different types of debris and dirt have build up at different locations on the instrument and the difficulties encountered in access to certain locations combine together to hinder effective, quick cleaning with normal cleaning implements. It would therefore be an advance in the art to provide an implement that is specifically designed for cleaning of string instruments and which would be effective in cleaning all areas of the instrument.

SUMMARY OF THE INVENTION

This invention provides a cleaning implement specifically adapted for use in cleaning stringed instruments. The implement includes two cleaning sections, one specifically adapted for use on body surfaces, including areas under the strings, and the other specifically adapted for use on the fingerboard—neck area.

The instrument is generally T-shaped having an intermediate body member topped at a distal end by a cross member and having a proximal end formed as an enlarged handle. The intermediate body member is relatively small in cross section and is bent or bowed between the handle and the cross member. The bowed portion is relatively, resiliently flexible. The cross member carries a soft cleaning pad member extending substantially the length of the cross member. The cross member is relatively thin in cross section thereby allowing it to move in conformity to surface variations of the instrument while being able to extend under the strings.

The handle is equipped with projecting bristles and is specifically adapted for cleaning the fingerboard, the bristles having a sufficient length and flexibility to allow the handle to be positioned over the fingerboard substantially out of contact with the strings except for the bristles, while having the bristles scrubingly engage the board's surface.

It is therefore an object of this invention to provide an improved cleaning instrument for stringed musical instruments having a soft surface cleaning area and a bristled cleaning area.

It is another and more specific object of this invention to provide a generally T-shaped cleaning instrument for stringed musical instruments where a cross arm at the top of a main intermediate body section is provided with a soft cloth-type covering on at least a top or bottom surface thereof and where a handle portion, spaced from the cross member at an opposite end of the intermediate body is provided with projecting bristles in the manner of a brush.

These and other objects of the invention will become apparent to those of ordinary skill in the art from the following description of the preferred embodiment.

DESCRIPTION OF THE PREFERRED EMBODIMENT

Figure 1:
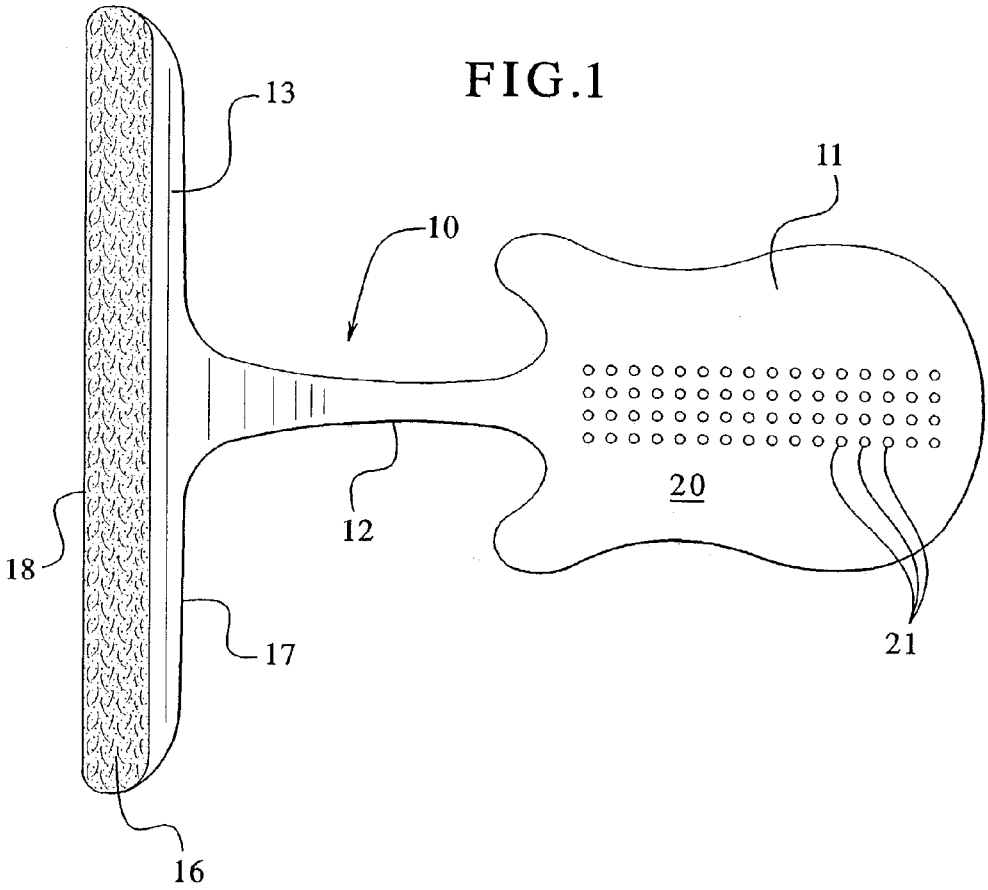
FIG. 1 is a bottom plan view of a cleaning instrument according to this invention.

As shown in the drawings the cleaning instrument 10 of this invention includes an body preferably of plastics material. The body may be one piece. The body is generally T-shaped having a handle 11, an intermediate body member 12 and a cross member 13 with the handle 11 affixed to a proximal end of the intermediate body member 12 and the cross member 13 affixed at the distal end.

The cross member 13 has an under surface 15 which carries a cleaning pad 16 extending the length of the cross member. The cleaning pad 16 is preferably soft and may be formed of a non-woven fabric such as felt. Alternatively the cleaning pad 16 may be formed of a soft weave material such as cotton or soft wool. The material chosen for the pad is specifically intended to be useful on the fine finish surface of the body of stringed instruments such as guitar or violins without scratching the surface.

The cross member is relatively long in a direction normal to the intermediate body member 12 and projects to each side of the intermediate member. Additionally the cross member is relatively narrow between its proximal edge 17 and its distal edge 18. In this manner it is easily manipulatable to conform to the contoured surfaces of the musical instrument's body and may also be slid under the strings in the playing area. By utilizing a relatively compact pad 16 and by positioning the cross member at the end of a relatively longer intermediate body member the brush may be used to clean most if not all areas of the body other than the fingerboard-neck area where the strings may be close to the underlying surface.

The handle 11, which may be fancifully shaped to resemble a particular musical instrument, as illustrated, is provided with a surface 20 having bristles 21 projecting therefrom. The bristles are particularly adapted to be used to clean the fingerboard under the strings and particularly in the area of the frets. To this end the bristles have a length and a spacing between individual bristles, which may be made of multiple strands, sufficient to facilitate the use of the bristle area in the manner of a scrub brush with the bristles brushingly engaging the fingerboard surface, preferably without the undersurface 20 of the handle contacting the strings.

In a specific exemplar the cleaning implement may be approximately five inches long between proximal and distal ends with the cross member being approximately four inches side to side and ½ inch in length. The intermediate body member varied from approximately ½ inch at the juncture with the cross member to about 3/16 inch at it narrowest. The handle was about 2½ inches long and 1¾ inches wide. The thickness of the plastic material was about 3/16 inches.

Figure 2:
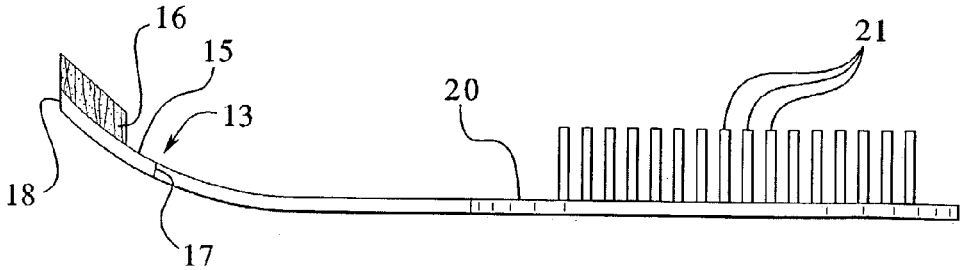
FIG. 2 is a side view of the cleaning instrument.

In order to facilitate maneuvering of the various cleaning surfaces, and to provide a degree of resiliency, the intermediate body portion 12 is bowed between the handle 11 and the cross member 13. As illustrated in FIG. 2 the bowing may be generally such as to place pad 16's surface at the same general level as the tips of the bristles 21. However, the bowing is primarily to allow the pad 16 to be urged against the surface with a force applied at the handle while preventing excessive force against the musical instrument's surface by means of the resilient yieldability of the intermediate body member. To this end the cross section of the intermediate body member is small in comparison with the handle and the dimension of the cross member and the material of the device is chosen to provide resiliency to the intermediate member.

It will therefore be appreciated from the above description that this invention provides a cleaning instrument uniquely adapted to be used for string instruments, the instrument including an elongated body having a soft cleaning pad at one end and projecting bristles adjacent the other end.

Various modifications will be apparent to those of ordinary skill in the art. For example, the cleaning pad 16 may wrap around the end edge 18 of the cross member or may be formed as a sleeve-like removable sheath. Additionally to increase the versatility of the instrument the bristles may be longer in one portion of the bristle carrying area and shorter in another portion and may similarly have different stiffness. Although I have chosen to show this embodiment with the cleaning pad 16 and the brushes carried by a relatively constant thickness body, it will be appreciated that other dimentionings are applicable and in particular the handle may be formed thicker than the cross member.

I claim as my invention:

1. A cleaning instrument particularly adapted for cleaning stringed musical instruments comprising an elongated thin body defining upper and lower opposing surfaces, said body having a generally T-shape with a cross member at one end of the body and a handle at the other end of the body, the cross member carrying a soft cleaning pad extending at least downwardly from the lower surface thereof and the handle carrying a plurality of projecting bristles extending downwardly from the lower surface, an intermediate body member between the handle and the cross member, the intermediate body member being longitudinally bowed and resiliently yieldable to allow the cross member to move relative to the handle.

2. A cleaning instrument according to claim 1 wherein the cleaning pad is formed of non-woven material.

3. A cleaning instrument for cleaning surfaces of stringed musical instruments comprising a device adapted to be hand-held said device including an elongated, thin body defining upper and lower opposing surfaces, said body being generally T-shaped in outline with an upright terminating at a distal end in a cross member substantially normal to the upright and in a handle portion at a proximal end with an intermediate member between the cross member and the handle portion, the intermediate member being dimensioned and longitudinally bowed to be bendable with respect to the handle and cross member, the cross member having a cleaning pad extending at least downwardly from the lower one surface of the cross member, the handle having projecting bristles extending downwardly from portions of a the lower surface of the handle.

4. A device according to claim 3 wherein the bottom surface of the cross member lies below the bottom surface of the handle.

5. A cleaning device comprising a generally T-shaped defined by a thin body with upper and lower opposing surfaces, said body device having a first body portion terminating in a cross member extending substantially normal to the first body portion having side edges, the handle portion, the first body portion terminating in an enlarged handle portion remote from the cross member, the cross member carrying a soft cleaning pad extending at least downwardly from the lower surface, the handle portion carrying projecting bristles substantially centrally thereof spaced from the side edges of the handle portion, said bristles extending downwardly from said lower surface to a greater extent than said pad from said lower surface and a resiliently yieldable intermediate section in said body portion between the cross member and the handle portion whereby the cross member may move relative to the handle portion.

* * * * *